United States Patent [19]

Sipilä et al.

[11] Patent Number: 4,571,196

[45] Date of Patent: Feb. 18, 1986

[54] WAY TO PROLONG THE SERVICE LIFE OF PROPORTIONAL COUNTERS

[75] Inventors: Heikki J. Sipilä, Espoo; Marja-Leena Järvinen, Helsinki, both of Finland

[73] Assignee: Outokumpu Oy, Helsinki, Finland

[21] Appl. No.: 575,825

[22] Filed: Feb. 1, 1984

[30] Foreign Application Priority Data

Feb. 2, 1983 [FI] Finland ..... 830353

[51] Int. Cl.[4] ..... H01J 9/395

[52] U.S. Cl. ..... 445/53; 313/643; 250/385

[58] Field of Search ..... 445/53; 313/643; 250/385

[56] References Cited

PUBLICATIONS

*Bolon et al., IEEE Transactions on Nuclear Science,* vol. NS-Z8, No. 1, (Feb. 1981), pp. 816–820.

*Primary Examiner*—Kenneth J. Ramsey

*Attorney, Agent, or Firm*—Brooks, Haidt, Haffner & Delahunty

[57] ABSTRACT

The invention concerns a way to prolong the service life of proportional counters, there being added to the gas mixture consisting of a rare gas and a hydrocarbon, serving as gas filling in the counters, hydrogen gas in the amount of 0.05–5.0% by weight, preferably 0.1–2.0% by weight. In addition, the hydrogen gas may in part at least be deuterium.

5 Claims, No Drawings

WAY TO PROLONG THE SERVICE LIFE OF PROPORTIONAL COUNTERS

The present invention concerns a way in which to prolong the service life of gas-filled proportional counters, a gas containing hydrogen being used as gas mixture in the counters.

It is common practice to use in gas-filled proportional counters, as gas mixtures, rare gases to which with a view to achieving higher gain have been added quenching gases. The quenching gases are usually simple hydrocarbons, methane for instance. The use of a mixture consisting of a rare gas and a hydrocarbon is considerably restricted by the short life span of the proportional counters, because under radiation load polymerisation products are formed of the hydrocarbon, which contaminate the anode wire or wires of the proportional counter, thereby at the same time impairing the properties of the proportional counter (Turala M., Vermeulen J. C., Ageing effects in drift chambers, CERN-EP-Raport 82-79).

The polymerisation contaminating the anode wire in a proportional counter is mainly due to the fact that in the gas amplification, which is a confined electric discharge in the gas, the hydrocarbon is decomposed into a radical and hydrogen. The following reaction then takes place (considering methane as example):

$$CH_4 \Sigma :CH_2 + H_2$$

The methylene $:CH_2$ thus produced reacts further with methane, producing ethane according to the reaction:

$$:CH_2 + CH_4 \rightarrow CH_3 - CH_3$$

In this way, longer and longer hydrocarbons are gradually formed in the discharge, which contaminate the anode wire of the proportional counter. Thereby, since the effective service life of the proportional counter depends on the height of the pulse being measured and this height, in its turn, on the stability of the anode wire diameter, the polymerisation products settling as contamination on the surface of the anode wire cause considerable shortening of the porportional counter's service life.

The service life of proportional counters filled with argon/methane and xenon/methane gas mixture has been considered e.g. in: Smith A., Turner M. J. L., Lifetime of proportional counters filled with xenon/methane and argon/methane, Nuclear Instruments and Medicine, 192 (1982) pp. 475–481. As stated in this paper, when using argon/methane gas (Ar 90% by weight, $CH_4$ 10% by weight), which is a popular gas filling owing to its low price and its properties, permitting high counting frequencies, the service life of the counters was established on the order of $5 \times 10^{10}$ pulses. When using xenon/methane gas mixture (Xe 90–95% by weight, $CH_4$ 10–5% by weight) for gas filling, the service life of the porportional counters was even shorter.

The object of the present invention is to inhibit the polymerisation products precipitated on the surface of the anode wire of a proportional counter from the gas filling, and thereby to prolong the service life of the counter, by adding hydrogen to the gas filling mixture.

When to the gas filling is added hydrogen as taught by the invention, this causes in the reaction presented above (using methane as example)

$$CH_4 \rightleftharpoons :CH_2 + H_2$$

the reaction equilibrium to shift to the side of the starting substance $CH_4$, at least in the initial stage of gas amplification, whereby thanks to the hydrogen gas present in the gas filling from before the initial polymerizing reaction can be inhibited over a comparatively long period. Thereby, since the stability of the proportional counter's anode wire diameter can be maintained by inhibiting the creation of polymerisation products, substantial prolongation of the porportional counter's service life is achieved in the way taught by the invention.

When adding hydrogen in the way taught by the invention to the gas filling of proportional counters one should also consider the potential effect of the addition on the characteristics of the counters, such as their efficiency and their resolution.

With a view to clarifying the influence exerted by the hydrogen addition of the invention on the service life of proportional counters and to finding out which is the advantageous amount of such addition, experiments were carried out with gas mixtures containing argon 90% by weight and methane or isobutane (i-$C_4H_{10}$) 10% by weight. To these mixtures was added hydrogen 0.01–10% by weight. Table 1 below presents the most favourable proportional counter service life lengths after hydrogen addition (radiation source Fe-55), juxtaposed with values obtained with gas mixtures of prior art.

TABLE 1

Effect of hydrogen addition on the service life of proportional counters

| Gas filling | Number of pulses |
|---|---|
| $Ar/CH_4$ | *$5.5 \times 10^{10}$ |
| $Ar/CH_4/H_2$ | $2.3 \times 10^{12}$ |
| $Ar/i\text{-}C_4H_{10}$ | $4.0 \times 10^{10}$ |
| $Ar/i\text{-}C_4H_{10}/H_2$ | $1 \times 10^{12}$ |

*Value Value from: Smith A., Turner, M.J.L., Lifetime of proportional counters filled with xenon-methane and argon-methane, Nuclear Instruments and Methods, 192 (1982) pp. 475–481.

It could be noted on the strength of the tests carried out that the influence on the service life of the proportional counter exerted by the hydrogen addition of the invention, when the addition had no substantial effect on other characteristics of the counter, was most favourable when the quantity added was 0.1–2.0% by weight of hydrogen. Furthermore, advantageous effects on the service life of the proportional counters employed could be noted with hydrogen addition between 0.05 and 5.0% by weight $H_2$, the life span increasing considerably.

The results in Table 1 reveal that the hydrogen addition of the invention, added to the commonly used $Ar/CH_4$ gas filling mixture, causes the service life of the proportional counter to be lengthened nearly hundredfold.

Although in the foregoing has been presented the adding of hydrogen to the gas filling of proportional counters when the quenching gas in the gas filling is methane or isobutane, it is equally possible to use other simple hydrocarbons for quenching gas, such as ethane, propane and/or isopropane, without causing any substantial change in the invention. Moreover, the hydrogen in the gas filling mixture may, in part at least, be replaced with heavy hydrogen, or deuterium, without incurring any diminution of the inhibition of polymerisation products according to the invention. Furthermore, it has no essential effect on the way according to the invention whether the hydrogen addition to the gas filling is applied in sealed or flow-type proportional counters.

We claim:

1. A method for prolonging the service life of a sealed proportional counter of the type filled with a gaseous mixture of a rare gas and a hydrocarbon, comprising adding hydrogen gas to the gas mixture.

2. The method according to claim 1 wherein the amount of hydrogen added is about 0.05% to 5.0% by weight calculated on the quantity of the gaseous mixture.

3. The method according to claim 1 wherein the amount of hydrogen added is about 0.1% to 2.0% by weight, calculated on the quantity of the gaseous mixture.

4. The method of claim 1 wherein the hydrogen gas is, at least in part, deuterium.

5. A sealed proportional counter having extended service life, filled with a gaseous mixture of a rare gas, a hydrocarbon and about 0.05% to 5.0% of hydrogen, calculated on the quantity of the gaseous mixture.

* * * * *

UNITED STATES PATENT AND TRADEMARK OFFICE

CERTIFICATE OF CORRECTION

PATENT NO. : 4,571,196

DATED : February 18, 1986

INVENTOR(S) : Heikki J. Sipila; Marja-Leena Jarvinen

It is certified that error appears in the above-identified patent and that said Letters Patent is hereby corrected as shown below:

Col. 1, line 31:

"$CH_4 \Sigma : CH_2 + H_2$" should read:

--$CH_4 \longrightarrow : CH_2 + H_2$--.

Signed and Sealed this

Thirteenth Day of May 1986

[SEAL]

Attest:

DONALD J. QUIGG

Attesting Officer

Commissioner of Patents and Trademarks